United States Patent [19]

Kowalyshen et al.

[11] Patent Number: 4,668,848

[45] Date of Patent: May 26, 1987

[54] ALIGNMENT AND CENTERING ARRANGEMENT FOR CONTACTS OF AN INTERRUPTING DEVICE

[75] Inventors: Henry W. Kowalyshen; John C. Opfer, both of Chicago; Norman J. Stranczek, Niles, all of Ill.

[73] Assignee: S&C Electric Company, Chicago, Ill.

[21] Appl. No.: 758,246

[22] Filed: Jul. 24, 1985

[51] Int. Cl.[4] ..... H01H 1/24

[52] U.S. Cl. ..... 200/248; 200/148 R; 200/245; 200/287

[58] Field of Search ..... 200/148 R, 148 A, 241, 200/248, 286, 287, 290

[56] References Cited

U.S. PATENT DOCUMENTS

| | | | |
|---|---|---|---|
| 1,001,796 | 8/1911 | Young | 200/287 |
| 1,915,948 | 6/1933 | Pedrazzo | 200/287 |
| 2,143,650 | 1/1939 | Douglas | 200/290 |
| 2,519,329 | 8/1950 | Woodward | 200/248 |
| 2,916,590 | 12/1959 | Mercier | 200/290 |
| 3,177,305 | 4/1965 | Lehman | 200/245 |
| 3,745,283 | 7/1973 | Bischofberger et al. | 200/148 R |
| 4,000,387 | 12/1976 | Milianowicz | 200/148 A |
| 4,241,248 | 12/1980 | Bernatt | 200/148 A |
| 4,384,185 | 5/1983 | Hall et al. | 200/148 R |

FOREIGN PATENT DOCUMENTS

| | | | |
|---|---|---|---|
| 829422 | 12/1969 | Canada | 200/245 |
| 1172761 | 6/1964 | Fed. Rep. of Germany | 200/245 |

*Primary Examiner*—Robert S. Macon

*Attorney, Agent, or Firm*—James V. Lapacek

[57] ABSTRACT

An alignment and centering arrangement is provided for effecting the self-centering of a first contact assembly and for effecting the self-alignment of the first contact assembly with a second contact assembly as the contact assemblies are positioned together for engagement. The alignment and centering arrangement provides a predetermined maximum range of pivoting movement of the first contact assembly with respect to a predetermined position while requiring minimal forces for effecting the self-alignment. Additionally, the alignment and centering arrangement accurately establishes a predetermined center position with orientation of the first contact assembly along a predetermined axis. In one configuration, the alignment and centering arrangement includes the resilient mounting of the first contact assembly with respect to a reference plane. The center position and orientation are established by the resilient mounting biasing the first contact assembly to a predetermined reference position with respect to the reference plane. The predetermined range of pivoting is provided by the interaction of the first contact assembly with structure that defines the reference plane.

6 Claims, 3 Drawing Figures

ALIGNMENT AND CENTERING ARRANGEMENT FOR CONTACTS OF AN INTERRUPTING DEVICE

BACKGROUND OF THE INVENTION

1. Field of the Invention

The present invention relates generally to the field of switches and interrupting devices and more particularly to an alignment and centering arrangement for the contacts of an interrupting device that effects the accurate self-centering of a first contact assembly and that effects the self-alignment of the first contact assembly with a second contact assembly as the contact assemblies are positioned together for engagement.

2. Description of the Related Art

Various contact structures and contact-mounting arrangements are known for circuit interrupting devices, for example, as disclosed in U.S. Pat. Nos. 4,000,387, 3,745,283, 4,384,185, and 4,241,248. The arrangement in U.S. Pat. No. 4,000,387 discloses a relatively-stationary contact struction and a movable contact structure. The relatively-stationary contact structure as seen in FIGS. 2 and 3 of the patent includes a spring-biased stationary contact 150. A contact-compression spring 179 seats upon a movable spring seat 186; the movable spring seat 186 apparently being affixed to the contact 150. The spring 179 at the other end thereof seats against a stationary spring seat 185. A supporting cylinder 183 carries the relatively-stationary contact 150. Relatively-stationary contact fingers 181 slide upon the supporting cylinder 183. The movable spring seat 186 is affixed to a plurality of spring-rods 188 which slide through openings in the stationary spring seat 185. The spring 179 provides for lost-motion travel of the contact 150 and is disposed about the contact fingers 181 and the supporting cylinder 183.

While the aforementioned arrangements are generally suitable for their intended purposes, these arrangements do not provide desirable alignment and centering arrangements for the contact structures. For example, the arrangement in U.S. Pat. No. 4,000,387 is not desirable for centering and alignment purposes due to the geometry, configuration and structure of the various elements and components thereof. An alignment and centering arrangement for contact structures is especially desirable in a circuit-interrupting device that includes long contact support members wherein the arrangement compensates for tolerances of the various components. An alignment and centering arrangement is also especially desirable in a circuit-interrupting device that includes an insulative housing wherein the arrangement compensates for variations in mounting orientations of the contact structures defined by the housing.

SUMMARY OF THE INVENTION

Accordingly, it is a principal object of the present invention to provide an alignment and centering arrangement for the contacts of an interrupting device that efficiently and accurately effects the self-centering of a first contact assembly and that effects predetermined self-alignment of the first contact assembly with a second contact assembly as the contact assemblies are positioned together for engagement.

It is another object of the present invention to provide an alignment and centering arrangement for the contacts of an interrupting device that requires minimal self-alignment or deflection forces and that accurately establishes a center position.

Briefly, these and other objects of the present invention are provided by an alignment and centering arrangement that effects the self-centering of a first contact assembly and that effects the self-alignment of the first contact assembly with a second contact assembly as the contact assemblies are positioned together for engagement. The alignment and centering arrangement provides a predetermined maximum range of pivoting movement of the first contact assembly with respect to a predetermined center position while requiring minimal forces for effecting the self-alignment. Additionally, the alignment and centering arrangement accurately establishes a predetermined center position with orientation of the first contact assembly along a predetermined axis. In one configuration, the alignment and centering arrangement includes the resilient mounting of the first contact assembly with respect to a reference plane. The center position is established along a predetermined axis by the resilient mounting biasing the first contact assembly to a predetermined reference position with respect to the reference plane. The predetermined range of pivoting is provided by the interaction of the first contact assembly with structure that defines the reference plane.

BRIEF DESCRIPTION OF THE DRAWING

The invention both as to its organization and method of operation, together with further objects and advantages thereof, will best be understood by reference to the specification taken in conjunction with the accompanying drawing in which.

DETAILED DESCRIPTION

Figure 1:
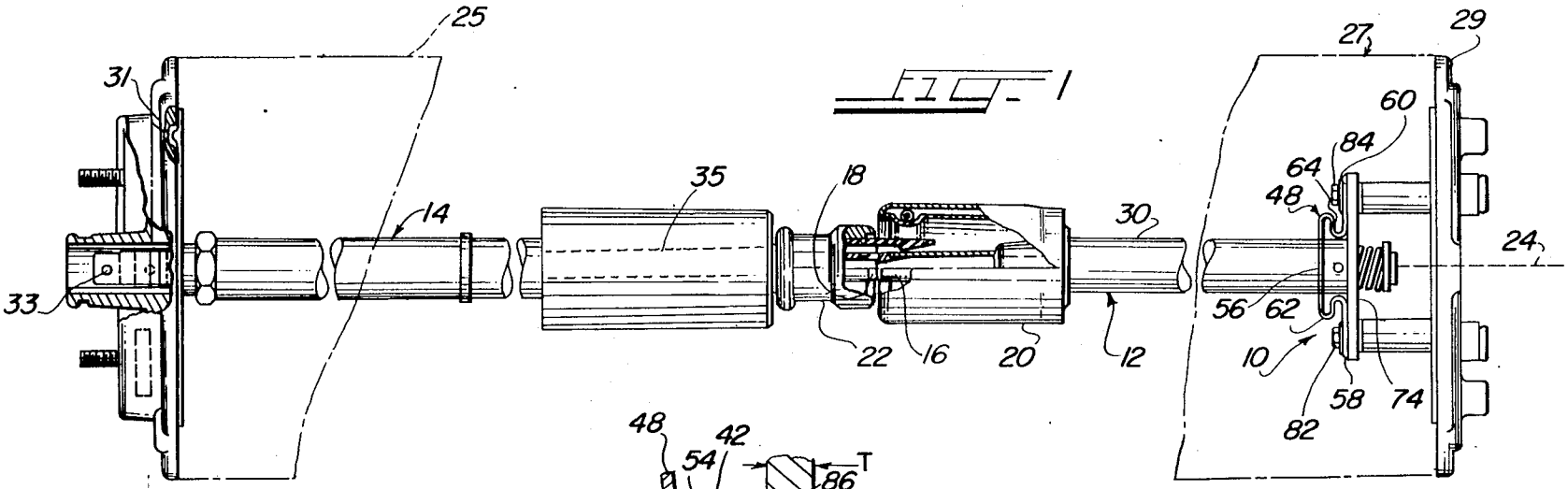
FIG. 1 is an elevational view partly in section of two contact assemblies of an interrupting device illustrating the application of the alignment and centering arrangement of the present invention.

Referring now to FIG. 1, the alignment and centering arrangement 10 of the present invention is illustrated for effecting the self-centering of a first contact assembly 12 and for effecting the self-alignment of the first contact assembly 12 with a second contact assembly 14 as the contact assemblies 12 and 14 are positioned together for engagement in a predetermined manner. In the illustrative application of the alignment and centering arrangement 10 of FIG. 1, a first arcing contact 16 carried by the first contact assembly 12 is arranged to butt with a second arcing contact 18 carried by the second contact assembly 14. The first contact assembly 12 also includes a first main contact 20 disposed about the first arcing contact 16. Similarly, the second contact assembly 14 includes a second main contact 22 disposed about the second arcing contact 18. With the contact assemblies 12 and 14 aligned along the axis 24 and moved toward one another, the arcing contacts 16,18 mate and upon subsequent movement the second main contact 22 enters the first main contact 20 and engages therewith.

In the illustrative arrangement of FIG. 1, the contact assemblies 12,14 are positioned within the bore of an insulator referred to generally at 25 to provide an interrupting unit 27. The first contact assembly 12 is supported by and electrically connected to a first end-cover assembly 29 via the alignment and centering arrangement 10. The second main contact assembly 14 is mounted with respect to a second end-cover assembly 31. The second arcing contact 18 and the main contact 22 are movable for contact opening and closing operation via reciprocation of an operating link 33 arranged to reciprocate a contact tube 35 connected to the second main contact 14 and the second arcing contact 18. Reference may be made to copending application Ser. Nos. 721,616 and 721,614 filed on Apr. 10, 1985 and to copending application Ser. No. 758,200 filed on July 24, 1985 for a more detailed discussion of an interrupting unit of this general type.

When it is desired to disengage the contacts to effect circuit interruption, the contact assemblies 12,14 are moved apart with the main contacts 20,22 disengaging to a predetermined separation while the arcing contacts 16,18 remain in contact due to a contact-follower configuration which is provided in a specific arrangement by the spring loading of the first arcing contact 16 with respect to the first contact assembly 12. This operation is desirable in high-voltage interrupting units for example, as provided by the parallel-contact arrangement. However, it should be realized that the alignment and centering arrangement 10 of the present invention is useful for switch arrangements of various types in addition to the specific illustrative arrangement of FIG. 1; for example, with main contacts only and with main contacts of various types.

Figure 2:
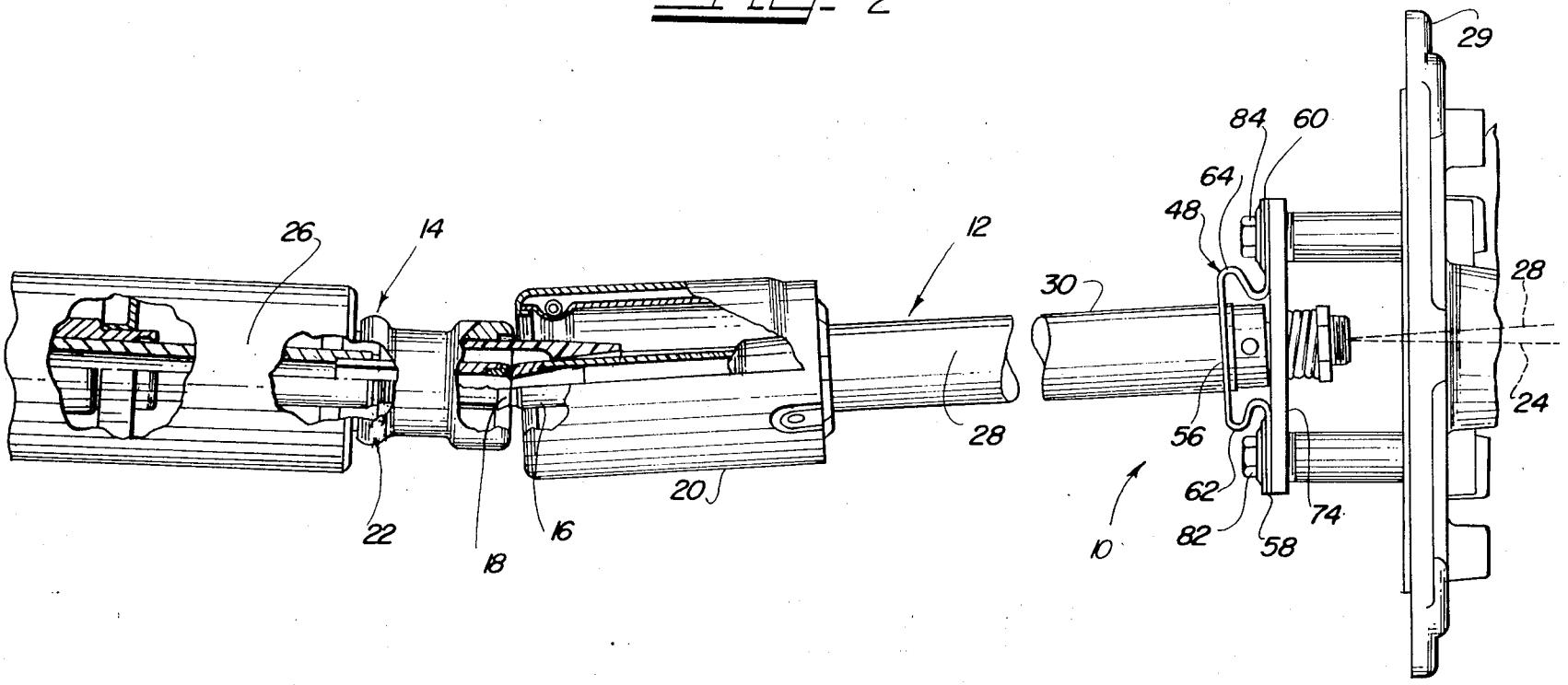
FIG. 2 is an elevational view of portions of the contact assemblies of FIG. 1 and illustrating the contact assemblies in a position of orientation offset with respect to an alignment axis.

Referring now additionally to FIG. 2, if the second contact assembly 14 is misaligned with orientation along axis 26 with respect to the alignment axis 24, the alignment and centering arrangement 10 permits the first contact assembly 12 to pivot, for example, to the orientation of axis 28 in response to the interaction of the contact assemblies 12,14 during contact-closing movement. Upon continued movement for further engagement, the pivoting of the first contact assembly 12 accomodates the orientation of the second contact assembly 14. Upon disengagement of the contact assemblies 12,14, the alignment and centering arrangement 10 returns the first contact assembly 12 to the center position with orientation along the axis 24.

Figure 3:
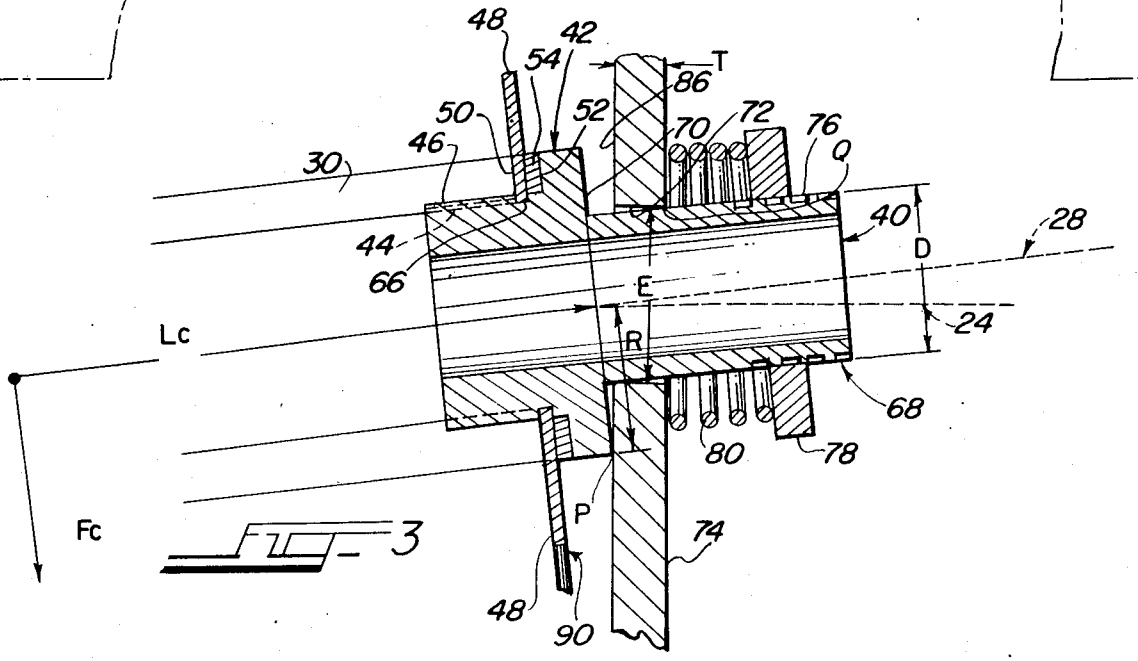
FIG. 3 is an enlarged view partly in section of portions of the contact assemblies and the alignment and centering arrangement of FIGS. 1 and 2.

The first contact assembly 12 includes a contact tube 30 that carries at one end thereof the first main contact 12 and the first arcing contact 16. Referring now additionally to FIG. 3, the other end of the contact tube 30 is carried by the alignment and centering arrangement 10. The alignment and centering arrangement 10 includes a mounting sleeve 40 having a first, widened portion 42. The widened portion 42 includes an externally threaded portion 44 that threadingly engages an internally threaded portion 46 of the contact tube 30. A flexible conductor 48 is fixed between the end 50 of the contact tube 30 and a widened, shoulder portion 52 of the mounting sleeve 40 via a spring washer 54 intermediate the shoulder 52 and the flexible conductor 48. The flexible conductor 48, as seen in FIG. 2, includes a central portion 56, intermediate "S"-curved portions 62,64 adjacent the central portion 56, and mounting portions 58,60 adjacent the "S"-curved portions 62,64 respectively. The central portion 56 of the flexible conductor 48 includes an aperture 66 (FIG. 3).

The mounting sleeve 40 includes a narrowed portion 68 extending from the widened portion 42 so as to define an alignment surface or annulus 70. The narrowed portion 68 is positioned through an aperture 72 of a support bar 74. The narrowed portion 68 of the mounting sleeve 40 includes an externally threaded portion 76 onto which a nut 78 is threaded. An alignment and centering spring 80 is positioned over the narrowed portion 68 and retained between the nut 78 and the support bar 74. As seen in FIG. 2, the support bar 74 and the flexible conductor 48 are affixed to the first and cover assembly 29 via suitable fasteners 82,84 which pass through apertures in the support bar 74 and the mounting portions 58,60 of the flexible conductor 48. While the alignment and centering spring 80 is illustrated in the embodiment of FIGS. 1–3, it should be realized that in other embodiments various resilient members are provided in lieu of the spring 80.

As can be been in detail in FIG. 3, the alignment and centering arrangement 10 permits the contact tube 30 to pivot relative to the support bar 74 and the centering axis 24 to a position with orientation for alignment along the axis 28, for example. The alignment and centering spring 80 normally biases the alignment surface 70 of the mounting sleeve 40 against the flat surface 86 of the support bar 74 to define a center position with orientation along the axis 24 such that the front surface 86 defines a reference plane; the reference plane serving to orientate and center the contact tube 30 at a right angle to the front surface 86 with the contact tube 30 and the sleeve 40 being aligned along the axis 24. Since the alignment surface 70 is circular, the contact tube 30 and the mounting sleeve 40 can deflect or pivot in any direction with respect to the axis 24; the alignment and centering spring 80 tending to return the contact assembly to the centered, aligned position along axis 24 from any such pivoted position.

Considering the alignment features that are provided as the contact assemblies 12 and 14 interact during contact-closing movement and assuming that the second contact assembly is misaligned with orientation along an axis 26, for example as shown in FIG. 2, reference to FIG. 3 illustrates that any force Fc lateral to the contact tube 30 results in pivoting of the contact tube 30 about the point P defined at the intersection of the alignment surface 70 and the front surface 86 of the support bar 74. If the force Fc is applied at a distance of Lc from the alignment surface 70, the following defines the relationship between the force Fc, the distance Lc, the radius R of the surface 70, and the force Fs of the spring 80: $FcLc = FsR$. Since R is much less than Lc, the force Fc to pivot the contact tube 30 is much less than the spring force Fs. The appropriate selection of the parameters Lc, R, and Fc permits the force Fc applied between the contact assemblies 12,14 to overcome the stiffness of the flexible conductor 48 and to exceed the force of gravity that normally acts upon the contact assembly 12 for non-vertical orientations of the contact assembly 12. The spring force Fs must be arranged to be greater than the force of gravity to maintain the correct self-centering position. In applications where the axis 24 is vertical, gravity has no effect on the determination of the spring force Fs.

In order to fix the desired amount of pivoting of the contact tube 30 to a predetermined limit, the diameter E of the aperture 72 of the support bar 74 is selected in relationship to the diameter D of the portion 68 and the thickness T of the support bar 74 such that the maximum pivoting results in the contact at point Q of the support bar 74 by the portion 68 of the mounting sleeve 40. Further, to limit the amount of sideways travel or movement of the sleeve 40 and carried contact tube 30, the clearance D-E between the portion 58 and the support bar 74 should be minimized. The desirable amount of pivoting of the contact tube 30 and the limiting of the sideways travel of the contact tube 30 determines that the thickness T of the support bar 74 be relatively thin; i.e., T should be small. Additionally, in order to provide a current path from the contact tube 30 to the outside of the end plate assembly 29 while minimizing the force Fc that is required for pivoting of the contact tube 30, the "S"-curved portions 62,64 of the flexible conductor 48 and a laminated structure for the flexible conductor 48 are provided in the preferred arrangement to enhance these desirable features. The laminated structure of the flexible conductor 48 is accomplished by the assembly of several thin strips each having the approximate shape of the overall conductor 48 as illustrated at 90 in FIG. 3.

While there have been illustrated and described various embodiments of the present invention, it will be apparent that various changes and modifications will occur to those skilled in the art. For example, the alignment surface 70 of the alignment and centering arrangement has been described as being biased against the flat surface 86 of the support bar 74 by a spring or other resilient element 80 that is positioned to the right of the support bar as shown in FIG. 3. However, it should be realized that in various other specific embodiments, resilient biasing arrangements are provided to the left of the support bar 74 to appropriately bias the alignment surface 70 against the support bar 74. It is intended in the appended claims to cover all such changes and modifications as fall within the true spirit and scope of the present invention.

What is claimed and desired to be secured by Letter Patent of the United States is:

1. An alignment and centering arrangement for the contacts of an interrupting unit comprising:

at least two contact assemblies, each of said contact assemblies including at least one contact and an elongated support member, said contacts being selectively engaged and disengaged by relative movement between said contact assemblies; and means for resiliently mounting a first of said elongated support members with respect to a reference plane, said resilient mounting means comprising means for establishing a center position and orientation of said first elongated support member with respect to said reference plane and for providing predetermined pivotal movement of said first elongated support member about a predetermined axis defined by said center position and orientation, said center position and orientation-defining means comprising first means affixed to said first elongated support member, second means arranged for cooperation with said first means and defining said reference plane, and resilient biasing means for biasing said first means to cooperate with said second means to define said center position and said orientation along said predetermined axis, said first means comprising an alignment surface that defines an alignment plane, said second means comprising a support element defining said reference plane, as said contact assemblies are moved toward one another, engagement of said contacts exerting forces to overcome said resilient biasing means to effect self-alignment of said contact assemblies, said predetermined pivotal movement occurring about a pivot point which is defined by the interaction of said support element and said alignment surface as said alignment surface is pivoted in response to said forces exerted by said contact assemblies.

2. The alignment and centering arrangement of claim 1 wherein said support element defines an aperture for passage of said first means, said first means comprising a first tubular portion having a predetermined outer diameter D that extends through said aperture, said diameter D along with the dimensions of the aperture and the thickness of said support element adjacent said aperture and in the direction of said predetermined axis defining the maximum pivotal movement of said first elongated support member with respect to said predetermined axis.

3. The alignment and centering arrangement of claim 2 wherein said first tubular portion includes means protruding therefrom for defining a retention member, said resilient biasing means comprising a resilient element disposed about said first tubular portion and acting between said support element and said retention member defining means.

4. The alignment and centering arrangement of claim 2 wherein said first means further comprises a second portion adjacent said first tubular portion, said second portion having a cross-section adjacent said support element that defines said alignment surface and that is larger than the dimensions of said aperture.

5. The alignment and centering arrangement of claim 1 wherein said first means is conductive and further comprises flexible conductor means for providing electrical connection of said first means.

6. In an electrical switch, an arrangement for mounting one contact assembly of the switch, the switch including two elongated contact assemblies which are engaged and disengaged by relative movement therebetween along a predetermined direction generally aligned with the axes defined by the elongated contact assemblies, the contact-assembly-mounting arrangment comprising:

means for carrying said one contact assembly;

a planar support element having an aperture; and means for resiliently mounting said carrying means with respect to said support element, a first portion of said carrying means adjacent said one contact assembly being disposed on a first side of said planar support element, a second portion of said carrying means being adjacent said first portion and being disposed on a second side of said planar support element, said resilient mounting means being disposed between said second side of said planar support member and a protuberance of said second portion, said first portion including a planar surface, said resilient mounting means biasing said planar surface of said first portion against said planar support element, engagement of said two contact assemblies resulting in pivoting of said first planar surface with respect to said planar support element about a point defined by the interaction forces of said two contact assemblies and the interaction of said first planar surface and said planar support element as said first planar surface is pivoted in response to said interaction forces.

* * * * *